US009490062B2

(12) United States Patent
Yoon et al.

(10) Patent No.: US 9,490,062 B2
(45) Date of Patent: Nov. 8, 2016

(54) CHIP ELECTRONIC COMPONENT

(71) Applicant: SAMSUNG ELECTRO-MECHANICS CO., LTD., Suwon-Si, Gyeonggi-Do (KR)

(72) Inventors: Chan Yoon, Suwon-Si (KR); Dong Hwan Lee, Suwon-Si (KR); Tae Young Kim, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 1 day.

(21) Appl. No.: 14/459,172

(22) Filed: Aug. 13, 2014

(65) Prior Publication Data

US 2015/0048915 A1 Feb. 19, 2015

(30) Foreign Application Priority Data

Aug. 14, 2013 (KR) ..... 10-2013-0096904

(51) Int. Cl.

| | |
|---|---|
| ***H01F 27/29*** | (2006.01) |
| ***H01F 5/00*** | (2006.01) |
| ***H01F 27/28*** | (2006.01) |
| ***H01F 17/00*** | (2006.01) |

(52) U.S. Cl.

CPC ..... *H01F 27/292* (2013.01); *H01F 17/0013* (2013.01); *H01F 2017/0066* (2013.01)

(58) Field of Classification Search

CPC ..... H01F 5/04; H01F 27/292; H01F 41/10; H01F 27/29; H01F 27/027; H01F 17/0013; H01F 27/2804

USPC ..... 336/192, 200, 83, 198, 232.223

See application file for complete search history.

(56) References Cited

U.S. PATENT DOCUMENTS

| | | | | |
|---|---|---|---|---|
| 4,661,792 | A * | 4/1987 | Watkins | H05K 1/145 336/192 |
| 5,985,414 | A * | 11/1999 | Fukuda | H01F 17/0013 333/185 |
| 6,903,919 | B2 * | 6/2005 | Kayatani | H01G 2/103 29/25.41 |
| 2002/0189083 | A1 * | 12/2002 | Matsumoto | H01F 27/027 29/743 |
| 2003/0052765 | A1 * | 3/2003 | Kanetaka | H01F 41/046 336/200 |
| 2005/0253677 | A1 * | 11/2005 | Ito | H01F 27/2804 336/200 |
| 2007/0152793 | A1 * | 7/2007 | Kim | H01F 27/027 336/200 |
| 2007/0182519 | A1 * | 8/2007 | Tsuzuki | H01F 17/0006 336/200 |
| 2011/0133881 | A1 * | 6/2011 | Nakajima | H01F 3/14 336/200 |
| 2012/0274432 | A1 * | 11/2012 | Jeong | H01F 27/2804 336/192 |

(Continued)

FOREIGN PATENT DOCUMENTS

| | | | |
|---|---|---|---|
| JP | 2007-067214 | A | 3/2007 |
| JP | 2013-045848 | A | 3/2013 |
| KR | 10-2012-0122589 | A | 11/2012 |

*Primary Examiner* — Elvin G Enad
*Assistant Examiner* — Kazi Hossain
(74) *Attorney, Agent, or Firm* — McDermott Will & Emery LLP

(57) ABSTRACT

A chip electronic component may include: a magnetic body including an insulating substrate; internal conductive pattern parts disposed on at least one surface of the insulating substrate; external electrodes disposed on the magnetic body and connected to the internal conductive pattern parts; and an additional magnetic layer disposed on a bottom surface of the magnetic body and covering portions of the external electrodes disposed on the bottom surface of the magnetic body.

6 Claims, 6 Drawing Sheets

(56) References Cited

U.S. PATENT DOCUMENTS

2012/0319811 A1* 12/2012 Chu ..... H01F 17/0013 336/200
2013/0194060 A1* 8/2013 Nakada ..... H01F 27/00 336/192
2013/0222101 A1* 8/2013 Ito ..... H01F 17/04 336/83

* cited by examiner

CHIP ELECTRONIC COMPONENT

CROSS-REFERENCE TO RELATED APPLICATION

This application claims the benefit of Korean Patent Application No. 10-2013-0096904 filed on Aug. 14, 2013, with the Korean Intellectual Property Office, the disclosure of which is incorporated herein by reference.

BACKGROUND

The present disclosure relates to a chip electronic component, and more particularly, to a chip inductor that may be included in an information technology (IT) device, or the like, to remove noise.

An inductor, a chip electronic component, is a representative passive element configuring an electronic circuit together with a resistor and a capacitor to remove noise. The inductor is combined with the capacitor using electromagnetic properties to configure a resonance circuit amplifying a signal in a specific frequency band, a filter circuit, or the like.

Recently, as information technology (IT) devices such as various communications devices, display devices, or the like, have been rapidly miniaturized and thinned, research into a technology for miniaturizing and thinning various elements such as an inductor, a capacitor, a transistor, and the like, used in these IT devices has been continuously conducted. Accordingly, the inductor has also been rapidly replaced by a chip having a small size and a high density and capable of being automatically surface-mounted, and a thin film inductor in which a mixture of a magnetic powder and a resin is provided on a coil conductive wire formed by plating has been developed.

As a chip size of the thin film inductor in which internal coil patterns are formed on upper and lower surfaces of a thin film insulating substrate has been gradually decreased as described above, a space for forming coil has been decreased, such that an area of the coil and a turn amount of the coil have been decreased and a volume of a magnetic material in which a magnetic flux may flow has also been decreased. As a result, it has been difficult to secure sufficient inductance.

In addition, according to the related art, cracks or delaminations frequently occur on interfaces between a magnetic material and external electrodes, causing a reliability problem.

RELATED ART DOCUMENT (Patent Document 1) Japanese Patent Laid-Open Publication No. 2007-067214

SUMMARY

An exemplary embodiment in the present disclosure may provide a chip electronic component having improved performance, in terms of an inductance (L), a quality factor (Q), and the like, by increasing a volume of a magnetic material inside a chip even in the case that a size thereof is decreased.

An exemplary embodiment in the present disclosure may also provide a chip electronic component capable of preventing the occurrence of cracks or delaminations and improving reliability by widening interfaces between a magnetic material and external electrodes contacting each other.

According to an exemplary embodiment in the present disclosure, a chip electronic component may include: a magnetic body including an insulating substrate; internal conductive pattern parts disposed on at least one surface of the insulating substrate; external electrodes disposed on the magnetic body and connected to the internal conductive pattern parts; and an additional magnetic layer disposed on a bottom surface of the magnetic body and covering portions of the external electrodes disposed on the bottom surface of the magnetic body.

According to another exemplary embodiment in the present disclosure, a chip electronic component may include: a magnetic body including an insulating substrate; internal conductive pattern parts disposed on at least one surface of the insulating substrate; stud electrodes exposed to both end surfaces of the magnetic body in a length direction thereof, having one ends connected to the internal conductive pattern parts, and extended in a thickness direction of the magnetic body; external electrodes connected to the other ends of the stud electrodes and disposed on a bottom surface of the magnetic body; and an additional magnetic layer disposed on the bottom surface of the magnetic body and covering portions of the external electrodes disposed on the bottom surface of the magnetic body.

According to another exemplary embodiment in the present disclosure, a chip electronic component mounted on a board may include: a magnetic body including an insulating substrate; internal conductive pattern parts disposed on at least one surface of the insulating substrate; external electrodes disposed on the magnetic body and connected to the internal conductive pattern parts; and an additional magnetic layer disposed on a bottom surface of the magnetic body and covering portions of the external electrodes disposed on the bottom surface of the magnetic body, wherein circuit parts disposed on the board and the external electrodes may be connected to each other through solder parts.

A thickness of the additional magnetic layer from the bottom surface of the magnetic body may be less than a sum of a thickness of the external electrode and thicknesses of the circuit part and the solder part disposed on the board.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
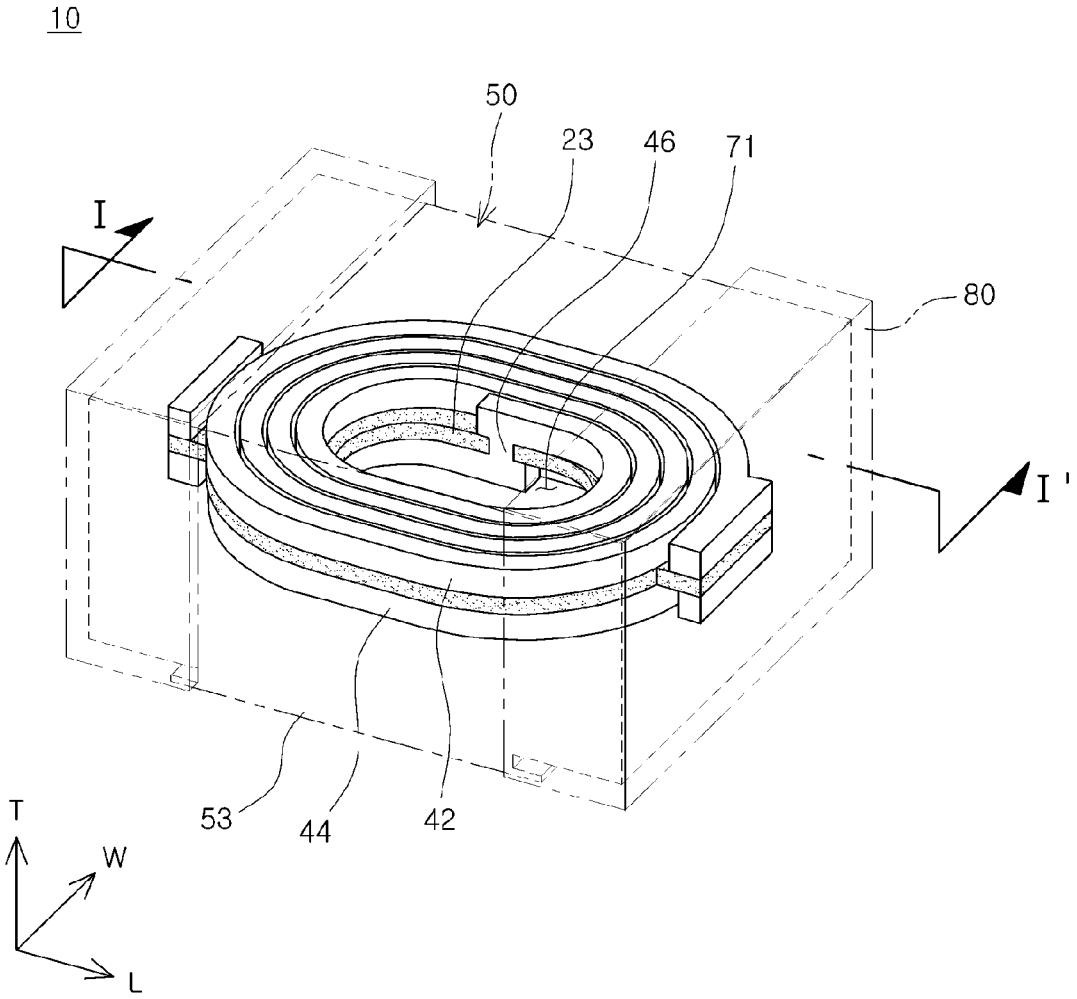
FIG. 1 is a perspective view illustrating a chip electronic component having internal coil patterns according to an exemplary embodiment in the present disclosure.

Hereinafter, exemplary embodiments of the present disclosure will be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Chip Electronic Component

Figure 2:
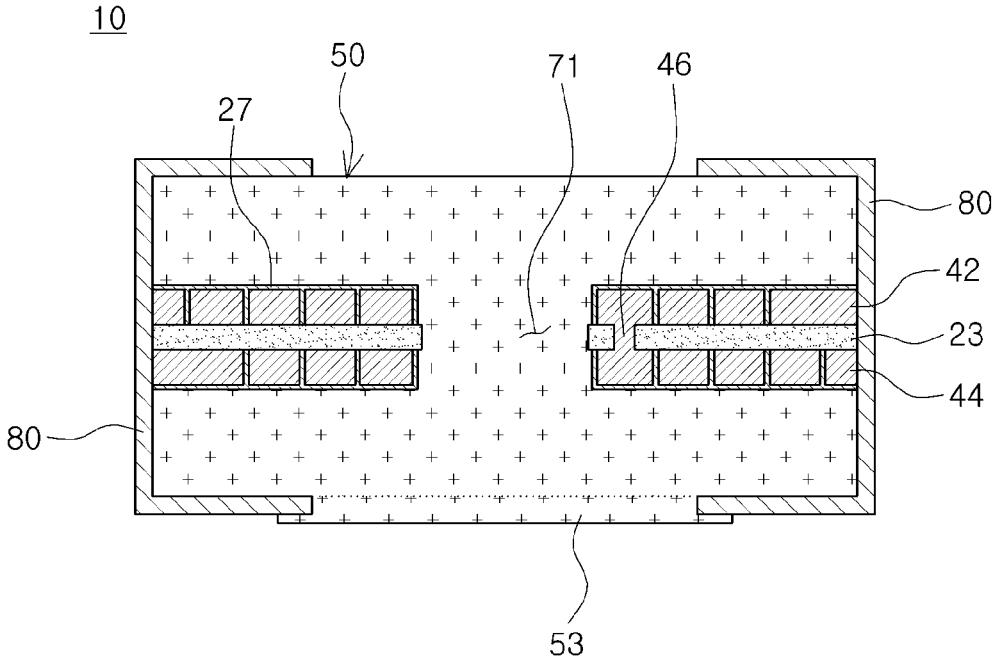
FIG. 2 is a cross-sectional view taken along line I-I' of FIG. 1.

FIG. 1 is a perspective view illustrating a chip electronic component having internal coil patterns according to an exemplary embodiment in the present disclosure; and FIG. 2 is a cross-sectional view of the chip electronic component of FIG. 1.

Referring to FIGS. 1 and 2, a thin film chip inductor 10 used in a power line of a power supply circuit is illustrated as an example of a chip electronic component. A chip bead, a chip filter, and the like, as well as the chip inductor, may be appropriately used as the chip electronic component.

The chip inductor 10 may include a magnetic body 50, an insulating substrate 23, internal conductive pattern parts 42 and 44, external electrodes 80, and an additional magnetic layer 53.

The magnetic body 50 may form the exterior of the chip inductor 10 and may be formed of any material that exhibits magnetic properties. For example, the magnetic body 50 may be formed by filling ferrite, a metal-based soft magnetic material, or the like. The metal-based soft magnetic material may be an Fe—Si—B—Cr-based amorphous metal powder material, but is not limited thereto.

The magnetic body 50 may have a hexahedral shape. Directions of a hexahedron will be defined in order to clearly describe an exemplary embodiment of the present disclosure. L, W, and T of a hexahedron illustrated in FIG. 1 refer to a length direction, a width direction, and a thickness direction, respectively.

The insulating substrate 23 formed in the magnetic body 50 may be formed of a thin film, and a material thereof is not particularly limited so long as it may be used to form the internal conductive pattern parts 42 and 44 by plating. The insulating substrate 23 may be, for example, a printed circuit board (PCB), a ferrite substrate, a metal-based soft magnetic substrate, or the like.

The insulating substrate 23 may have a through hole formed in a central portion thereof, wherein the through hole may be filled with a magnetic material such as a metal-based soft magnetic material, or the like, to form a core part 71. The core part 71 may be filled with the magnetic material, thereby increasing an inductance L.

The insulating substrate 23 may have the internal conductive pattern parts 42 and 44 formed on one surface and the other surface thereof, respectively, wherein the internal conductive pattern parts 42 and 44 have coil-shaped patterns.

The internal conductive pattern parts 42 and 44 may include coil patterns having a spiral shape, and the internal conductive pattern parts 42 and 44 formed on one surface and the other surface of the insulating substrate 23, respectively, may be electrically connected to each other through a via electrode 46 formed in the insulating substrate 23.

The internal conductive pattern parts 42 and 44 and the via electrode 46 may be formed of a metal having excellent electrical conductivity, for example, silver (Ag), copper (Cu), nickel (Ni), aluminum (Al), or alloys thereof, but are not limited thereto.

According to an exemplary embodiment in the present disclosure, one end portion of the internal conductive pattern part 42 formed on one surface of the insulating substrate 23 may be exposed to one end surface of the magnetic body 50 in a length direction thereof, and one end portion of the internal conductive pattern part 44 formed on the other surface of the insulating substrate 23 may be exposed to the other end surface of the magnetic body 50 in the length direction thereof.

The external electrodes 80 may be formed on both end surfaces of the magnetic body 50 in the length direction thereof, respectively, so as to be connected to the internal conductive pattern parts 42 and 44 exposed to both end surfaces of the magnetic body 50 in the length direction thereof, respectively. The external electrodes 80 may be extended to both end surfaces of the magnetic body 50 in the thickness direction thereof and/or both end surfaces of the magnetic body 50 in the width direction thereof.

The external electrodes 80 may be formed of a metal having excellent electrical conductivity, for example, nickel (Ni), copper (Cu), tin (Sn), silver (Ag), or alloys thereof, but are not limited thereto.

The magnetic body 50 may have the additional magnetic layer 53 formed on a bottom surface thereof in the thickness direction thereof. The additional magnetic layer 53 may be directly connected to the bottom surface of the magnetic body 50 and may cover portions of the external electrodes 80 formed on the bottom surface of the magnetic body 50.

Due to the forming of the additional magnetic layer 53, a volume of a magnetic material, in which a magnetic flux may flow, may be increased, whereby the inductor may have improved performance in terms of an inductance (L), a quality factor (Q), direct current (DC) bias characteristics, and the like. In addition, the additional magnetic layer 53 may cover the portions of the external electrodes 80 to increase adhesion strength of the external electrodes, thereby improving reliability.

The additional magnetic layer 53 may be formed to have a thickness of 30 μm to 60 μm from the bottom surface of the magnetic body 50. In the case in which the thickness of the additional magnetic layer 53 is less than 30 μm, the thickness of the additional magnetic layer 53 is less than that of the external electrodes, causing a limitation in improving the adhesion strength of the external electrodes. In the case in which the thickness of the additional magnetic layer 53 exceeds 60 μm, a size of a chip itself may be increased.

The additional magnetic layer 53 may cover 5% to 30% of an area of the portions of the external electrodes 80 formed on the bottom surface of the magnetic body 50. In the case in which the additional magnetic layer 53 covers less than 5% of the area of the portions of the external electrodes, it fails to improve the adhesion strength of the external electrodes, resulting in occurrence of cracks and delaminations. In the case in which the additional magnetic layer 53 covers more than 30% of the area of the portions of the external electrodes, a mounting area of the external electrodes may be excessively decreased.

The additional magnetic layer 53 may be formed of any material that has magnetic characteristics. For example, the additional magnetic layer 53 may be formed by filling ferrite, a metal-based soft magnetic material, or the like. The metal-based soft magnetic material may be an Fe—Si—B—

Cr-based amorphous metal powder material, but is not limited thereto. The additional magnetic layer 53 may be formed of the same magnetic material as that of the magnetic body 50.

Figure 3:
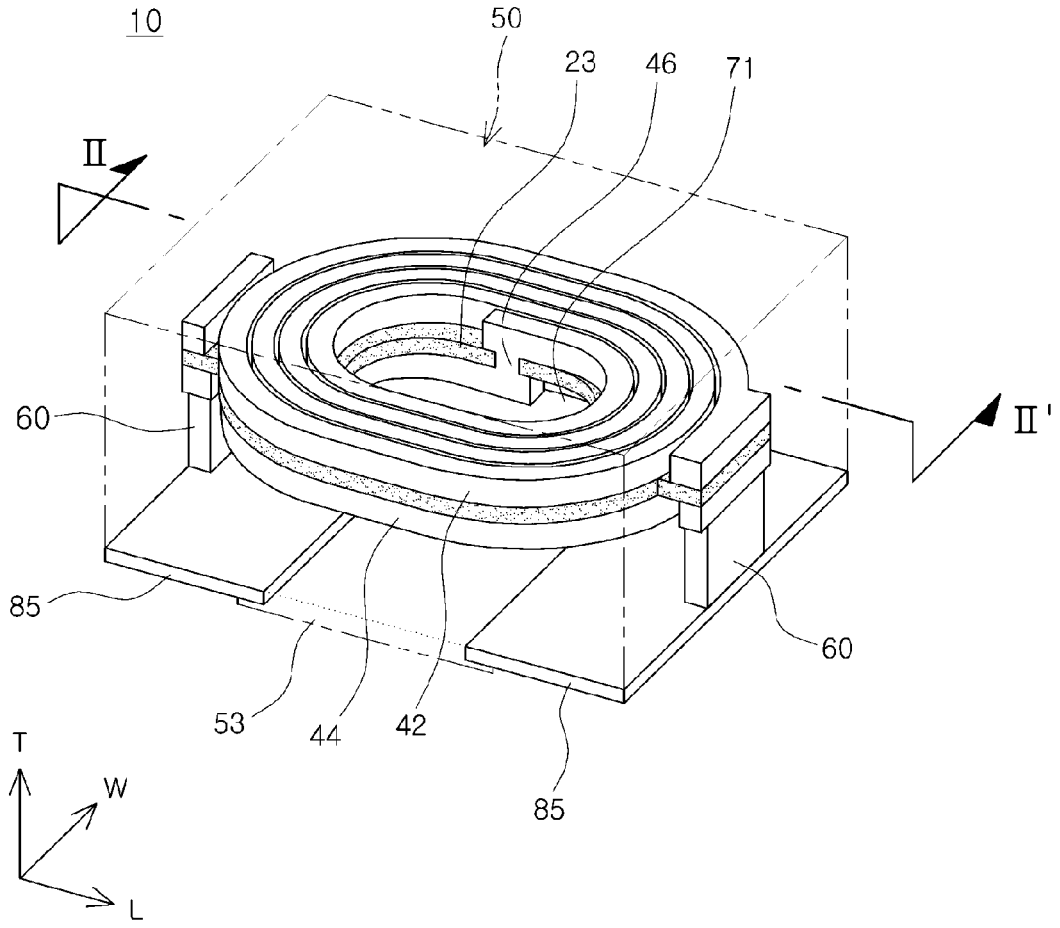
FIG. 3 is a perspective view illustrating a chip electronic component having internal coil patterns according to another exemplary embodiment in the present disclosure.
Figure 4:
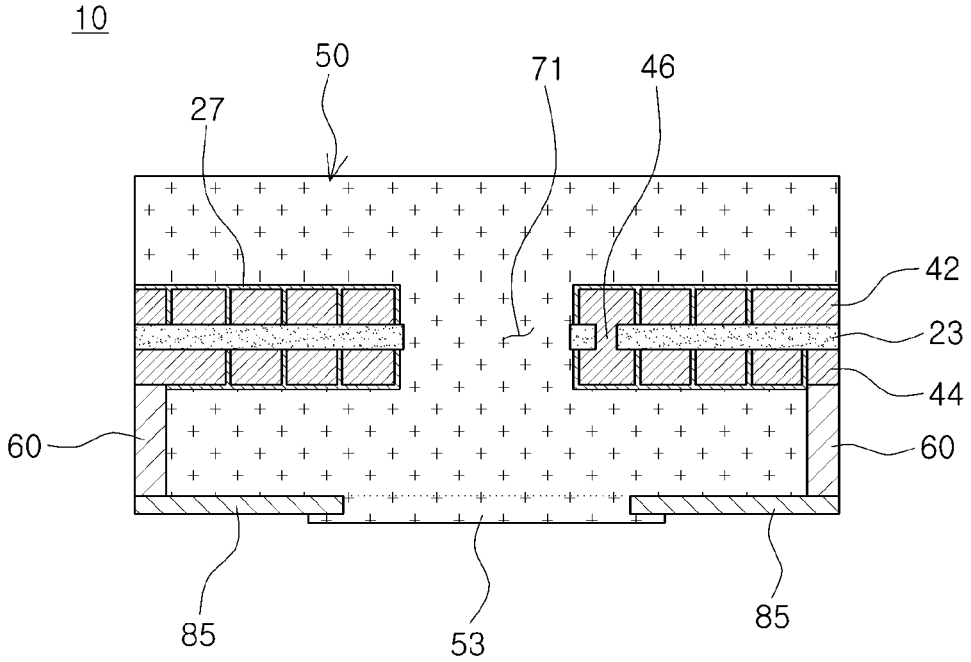
FIG. 4 is a cross-sectional view taken along line II-II' of FIG. 3.

Meanwhile, FIG. 3 is a perspective view illustrating a chip electronic component having internal coil patterns according to another exemplary embodiment of the present disclosure; FIG. 4 is a cross-sectional view of the chip electronic component of FIG. 3; and FIG. 5 is a cross-sectional view illustrating a flow of a magnetic flux.

Figure 5:
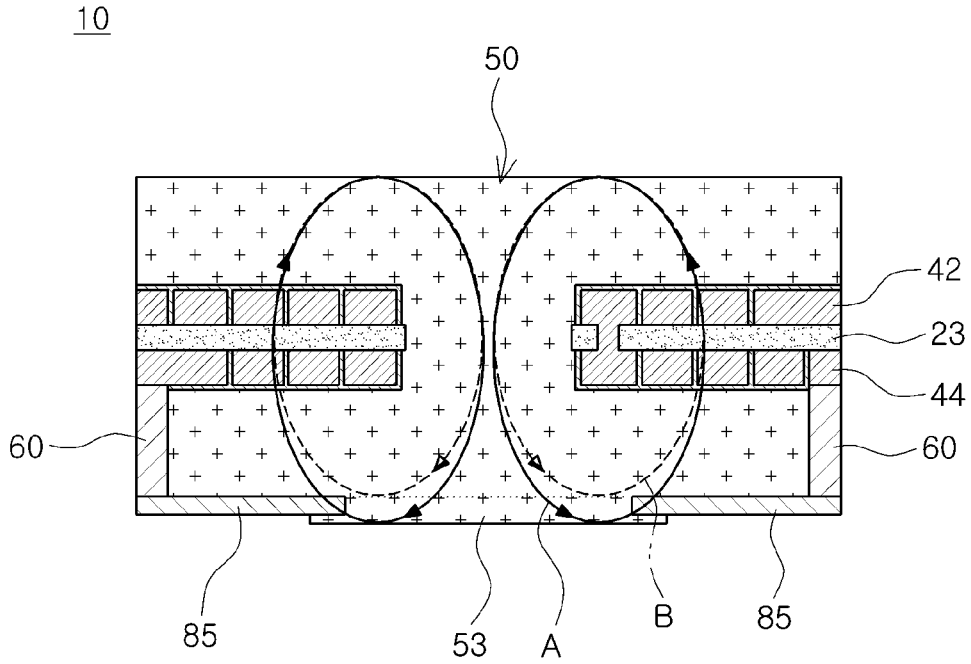
FIG. 5 is a cross-sectional view illustrating a flow of a magnetic flux.

Referring to FIGS. 3 through 5, the chip electronic component 10 according to this exemplary embodiment of the present disclosure may include stud electrodes 60 and external electrodes 85 formed on the bottom surface of the magnetic body 50.

The stud electrodes 60 may be exposed to both end surfaces of the magnetic body 50 in the length direction thereof, respectively. One ends of the stud electrodes 60 may be connected to the internal conductive pattern part 44, and may be extended in the thickness direction of the magnetic body 50.

The additional magnetic layer 53 may be formed to be connected to the stud electrodes 60 and to cover portions of the external electrodes 85 formed on the bottom surface of the magnetic body 50.

As illustrated in FIG. 5, a flow of a magnetic flux A generated in the case in which the additional magnetic layer 53 is formed is greater than that of a magnetic flux B generated in the case in which the additional magnetic layer is not formed, whereby the performance of the inductor may be improved.

Figure 6:
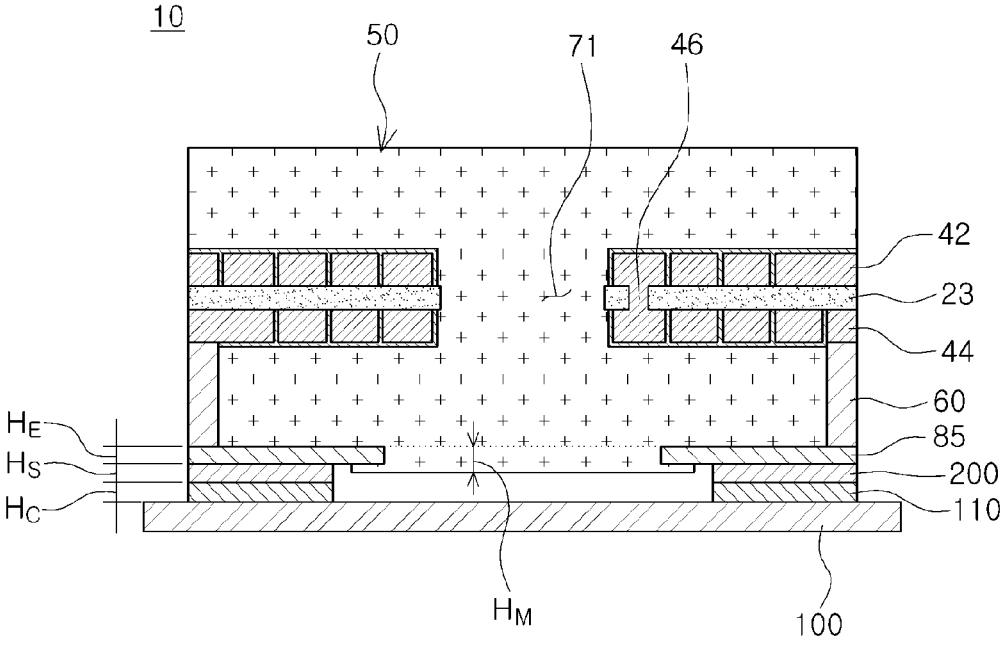
FIG. 6 is a cross-sectional view illustrating a chip electronic component according to an exemplary embodiment in the present disclosure, which is mounted on a board.

FIG. 6 is a cross-sectional view illustrating a chip electronic component according to an exemplary embodiment of the present disclosure, which is mounted on a board.

Referring to FIG. 6, the chip electronic component 10 may be mounted on a board 100 so that the external electrodes 85 are electrically connected to circuit parts 110 formed on the board 100 through solder parts 200.

Here, a thickness $H_M$ of the additional magnetic layer 53 covering the external electrodes 85 may be less than the sum of a thickness $H_E$ of the external electrode 85, a thickness $H_C$ of the circuit part 110, and a thickness $H_S$ of the solder part 200. By forming the additional magnetic layer 53 to have a thickness less than the sum of the thickness $H_E$ of the external electrode 85, the thickness $H_C$ of the circuit part 110, and the thickness $H_S$ of the solder part 200, a volume of the magnetic material in which the magnetic flux may flow may be increased, without an increase in an actual height of the mounted chip, whereby the inductor may have improved performance in terms of the inductance (L), the quality factor (Q), and the like.

Method of Manufacturing Chip Electronic Component

FIGS. 7A through 7D are views schematically illustrating a method of manufacturing a chip electronic component according to an exemplary embodiment of the present disclosure.

Figure 7A:
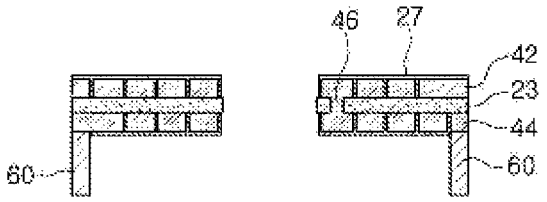
FIGS. 7A through 7D are views schematically illustrating a method of manufacturing a chip electronic component according to an exemplary embodiment in the present disclosure.

Referring to FIG. 7A, the internal conductive pattern parts 42 and 44 may be formed on one surface and the other surface of the insulating substrate 23, respectively, and the stud electrodes 60 may be formed to be connected to the internal conductive pattern part 44 formed on the other surface of the insulating substrate 23.

A through hole may be formed in a portion of the insulating substrate 23 and may be filled with a conductive material to form the via electrode 46, and the internal conductive pattern parts 42 and 44 formed on one surface and the other surface of the insulating substrate 23, respectively, may be electrically connected to each other through the via electrode 46.

The through hole may be formed in the central portion of the insulating substrate 23 by drilling, laser processing, sandblasting, punching, or the like.

The internal conductive pattern parts 42 and 44 formed on one surface and the other surface of the insulating substrate 23, respectively, may be coated with an insulating layer 27. The insulating layer 27 may be formed by a dipping method, a coating method, an exposure and development method, and a material such as an epoxy resin, a solder resist, and the like may be used therefor.

Figure 7B:
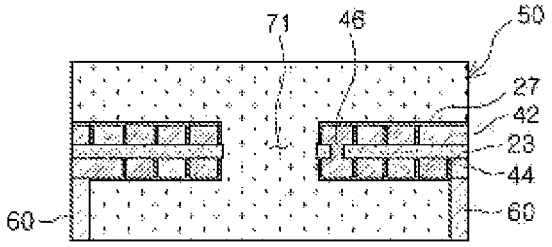

Referring to FIG. 7B, the magnetic body 50 containing a magnetic material and a resin may be formed on upper and lower surfaces of the insulating substrate 23 on which the internal conductive pattern parts 42 and 44 are formed. Magnetic layers may be stacked on both surfaces of the insulating substrate 23, and be compressed by a lamination method or an isostatic pressing method to form the magnetic body 50. Here, the hole may be filled with the magnetic material to form the core part 71.

Figure 7C:
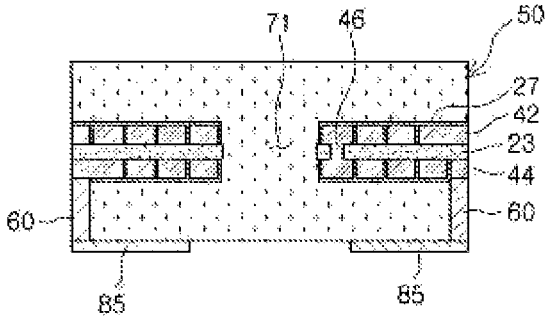

Referring to FIG. 7C, the external electrodes 85 may be formed on the bottom surface of the magnetic body 50 so as to be connected to the stud electrodes 60. The external electrodes 85 may be printed on the bottom surface of the magnetic body 50. The external electrodes 85 may be formed by a printing method, a dipping method, or the like, depending on a shape thereof.

Figure 7D:
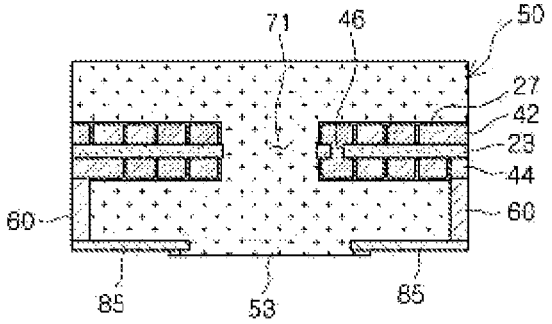

Referring to FIG. 7D, the additional magnetic layer 53 may be formed on the bottom surface of the magnetic body 50 on which the external electrodes 85 are formed. The additional magnetic layer 53 may be formed by additionally applying a magnetic material to portions of the external electrodes 85 formed on the bottom surface of the magnetic body 50 and compressing the magnetic material.

As set forth above, in the chip electronic component according to exemplary embodiments of the present disclosure, the volume of the magnetic material in which the magnetic flux may flow may be increased inside the chip even in the case that the chip is miniaturized, whereby an inductance may be significantly increased.

In addition, the interfaces between the magnetic material and the external electrodes may be increased to improve the adhesion strength of the external electrodes and prevent the occurrence of cracks or delaminations, whereby reliability may be improved.

While exemplary embodiments have been shown and described above, it will be apparent to those skilled in the art that modifications and variations could be made without departing from the spirit and scope of the present disclosure as defined by the appended claims.

What is claimed is:

1. A chip electronic component mounted on a board, comprising:

a magnetic body including an insulating substrate;

an internal conductive pattern part disposed on at least one surface of the insulating substrate;

external electrodes disposed on the magnetic body and connected to the internal conductive pattern part; and an additional magnetic layer disposed on a bottom surface of the magnetic body and covering at least a portion of the external electrodes disposed on the bottom surface of the magnetic body, wherein circuit parts disposed on the board and the external electrodes are connected to each other through solder parts, and a thickness of the additional magnetic layer from the bottom surface of the magnetic body is less than a sum of a thickness of the external electrode and thicknesses of the circuit part and the solder part disposed on the board.

2. The chip electronic component mounted on a board of claim 1, wherein the additional magnetic layer has a thickness of 30 μm to 60 μm from the bottom surface of the magnetic body.

3. The chip electronic component mounted on a board of claim 1, wherein the additional magnetic layer is connected to the magnetic body.

4. The chip electronic component mounted on a board of claim 1, wherein the additional magnetic layer covers 5% to 30% of an area of the portion of the external electrodes disposed on the bottom surface of the magnetic body.

5. The chip electronic component mounted on a board of claim 1, wherein the additional magnetic layer contains at least one selected from a group consisting of ferrite and a metal-based soft magnetic material.

6. The chip electronic component mounted on a board of claim 1, wherein the magnetic body has a hexahedral shape.

* * * * *